US006328629B1

(12) United States Patent
Togawa et al.

(10) Patent No.: US 6,328,629 B1
(45) **Date of Patent: *Dec. 11, 2001**

(54) METHOD AND APPARATUS FOR POLISHING WORKPIECE

(75) Inventors: Tetsuji Togawa, Chigasaki; Norio Kimura; Koji Ono, both of Fujisawa, all of (JP)

(73) Assignee: Ebara Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/026,122

(22) Filed: Feb. 19, 1998

(30) Foreign Application Priority Data

Feb. 19, 1997 (JP) ..... 9-051078

(51) Int. Cl.[7] ..... B24B 49/08

(52) U.S. Cl. ..... 451/8; 451/287; 451/288; 451/388; 451/398

(58) Field of Search ..... 451/287, 288, 451/41, 388, 398, 8

(56) References Cited

U.S. PATENT DOCUMENTS

| | | | | |
|---|---|---|---|---|
| 4,193,226 | * | 3/1980 | Gill, Jr. et al. | 51/124 R |
| 4,269,057 | * | 5/1981 | Ong et al. | 73/1 G |
| 4,680,893 | * | 7/1987 | Cronkhite et al. | 51/5 R |
| 5,324,087 | * | 6/1994 | Shimose et al. | 294/64.1 |
| 5,443,416 | * | 8/1995 | Volodarsky et al. | 451/388 |
| 5,476,414 | * | 12/1995 | Hirose et al. | 451/288 |
| 5,670,011 | | 9/1997 | Togawa et al. | 156/345 |
| 5,733,171 | | 3/1998 | Allen et al. | 451/5 |
| 5,800,248 | * | 9/1998 | Pant et al. | 451/41 |
| 5,803,799 | * | 9/1998 | Volodarsky et al. | 451/288 |
| 5,823,853 | | 10/1998 | Bartels et al. | 451/5 |
| 5,851,140 | * | 12/1998 | Barns et al. | 451/288 |
| 5,857,893 | * | 1/1999 | Olsen et al. | 451/5 |
| 5,885,135 | * | 3/1999 | Desorcie et al. | 451/41 |
| 5,890,951 | * | 4/1999 | Vu | 451/56 |
| 5,904,608 | | 5/1999 | Watanabe | 451/5 |
| 5,957,751 | | 9/1999 | Govzmann et al. | 451/8 |

* cited by examiner

*Primary Examiner*—Joseph J. Hail, III
*Assistant Examiner*—William Hong
(74) *Attorney, Agent, or Firm*—Wenderoth, Lind & Ponack, L.L.P.

(57) ABSTRACT

A workpiece such as a semiconductor wafer is held by a top ring, and a lower surface of the workpiece is polished to a flat mirror finish by being pressed against a polishing surface of the turntable while the top ring and the turntable are rotated. While the workpiece is being polished, at least one of the pressure and the flow rate of a fluid which is supplied to an upper surface of the workpiece is detected. When at least one of the detected pressure and the detected flow rate changes, the polishing of the workpiece is stopped.

16 Claims, 3 Drawing Sheets

METHOD AND APPARATUS FOR POLISHING WORKPIECE

BACKGROUND OF THE INVENTION

1. Field of the Invention

The present invention relates to a method and apparatus for polishing a workpiece, and more particularly to a method and apparatus for polishing a planar workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small. Conventionally, as apparatuses for planarizing semiconductor wafers, there have been used a self-planarizing CVD apparatus, an etching apparatus or the like, however, these apparatuses fail to fully planarize semiconductor wafers. Recently, attempts have been made to use a polishing apparatus for planarizing semiconductor wafers to a flatter finish with more ease than those conventional planarizing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated. This process is called Chemical Mechanical polishing.

After the semiconductor wafer is polished, it is detached from the top ring, and transferred to a next process such as a cleaning process.

While a workpiece such as a semiconductor wafer is being polished, it occasionally is broken into pieces which are scattered on the polishing cloth. Each time the workpiece being polished is broken, the polishing cloth has to be replaced with a new one because fragments of the workpiece on the polishing cloth would otherwise cause damage to the surface of another workpiece to be polished. Another problem is that a workpiece such as a semiconductor wafer which is being polished is sometimes disengaged from the top ring due to lack of secure attachment of the workpiece to the top ring. If the workpiece is a fragile object such as a semiconductor silicon wafer, then an outer circumferential edge of the workpiece may suffer same damage such as chipping upon collision with a wall surface that covers the turntable. When the damaged workpiece is polished again, it can easily be broken apart under small forces which are applied to the damaged area or thereabouts of the workpiece.

There have been made various efforts to prevent a workpiece from being broken and also from being disengaged from the top ring. For example, a cushioning member such as an elastic mat is interposed between the top ring and the workpiece to reduce cracking or chipping of the workpiece while the workpiece is being polished. A retainer ring is provided on the outer periphery of the top ring to retain the outer circumferential edge of the workpiece and to firmly hold the workpiece on the top ring for thereby preventing the workpiece from being disengaged from the top ring while the workpiece is being polished.

However, the above attempts fail to completely prevent the workpiece from being broken or being disengaged from the top ring while the work piece is being polished. Since the polishing process is continued even when the workpiece is broken or disengaged from the top ring, various resultant problems have not been eliminated.

SUMMARY OF THE INVENTION

It is therefore an object of the present invention to provide a method and apparatus for polishing a workpiece while monitoring the workpiece continuously when it is being polished, for thereby minimizing damage that would otherwise be caused when the workpiece is broken or disengaged from a top ring.

According to one aspect of the present invention, there is provided a method for polishing a lower surface of a workpiece, the method comprising: holding a workpiece by a top ring; polishing the lower surface of the workpiece by pressing the workpiece against a polishing surface of a turntable; detecting at least one of a pressure and a flow rate of a fluid which is supplied to an upper surface of the workpiece while the workpiece is being polished; and stopping polishing of the workpiece when at least one of the detected pressure and the detected flow rate changes.

According to another aspect of the present invention, there is provided a method for polishing a lower surface of a workpiece, the method comprising: attracting a workpiece to a top ring under vacuum from a vacuum source; detecting at least on of a pressure and a flow rate of a gas in a vacuum line interconnecting the top ring and the vacuum source to judge whether the workpiece is properly attracted to the top ring; polishing the lower surface of the workpiece by pressing the workpiece against a polishing surface of a turntable; and detecting at least one of a pressure and a flow rate of a fluid which is supplied to an upper surface of the workpiece while the workpiece is being polished to judge whether the workpiece is damaged.

According to still another aspect of the present invention, there is provided an apparatus for polishing a lower surface of a workpiece, the apparatus comprising: a turntable having a polishing surface on an upper surface thereof; a top ring disposed above the turntable and holding a workpiece to be polished and pressing the workpiece against the polishing surface, the top ring having a plurality of openings; a pressurized fluid source for supplying a fluid under pressure through the openings to an upper surface of the workpiece; a detector disposed between the openings and the pressurized fluid source for detecting at least one of a pressure and a flow rate of the fluid supplied from the pressurized fluid source; and a controller for stopping polishing of the workpiece when at least one of the detected pressure and the detected flow rate changes.

According to the present invention, while the workpiece is attached to the top ring, polished and removed from the top ring, the workpiece is always monitored for occurrence of damage. Therefore, the workpiece is prevented from being broken in a sequence of process including attachment of the workpiece to the top ring, polishing, and detachment of the workpiece from the top ring. Any damage which would otherwise be caused when the workpiece is broken is reduced to a minimum.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Next, a polishing apparatus according to an embodiment of the present invention will be described below with reference to FIGS. 1 through 3.

Figure 1:
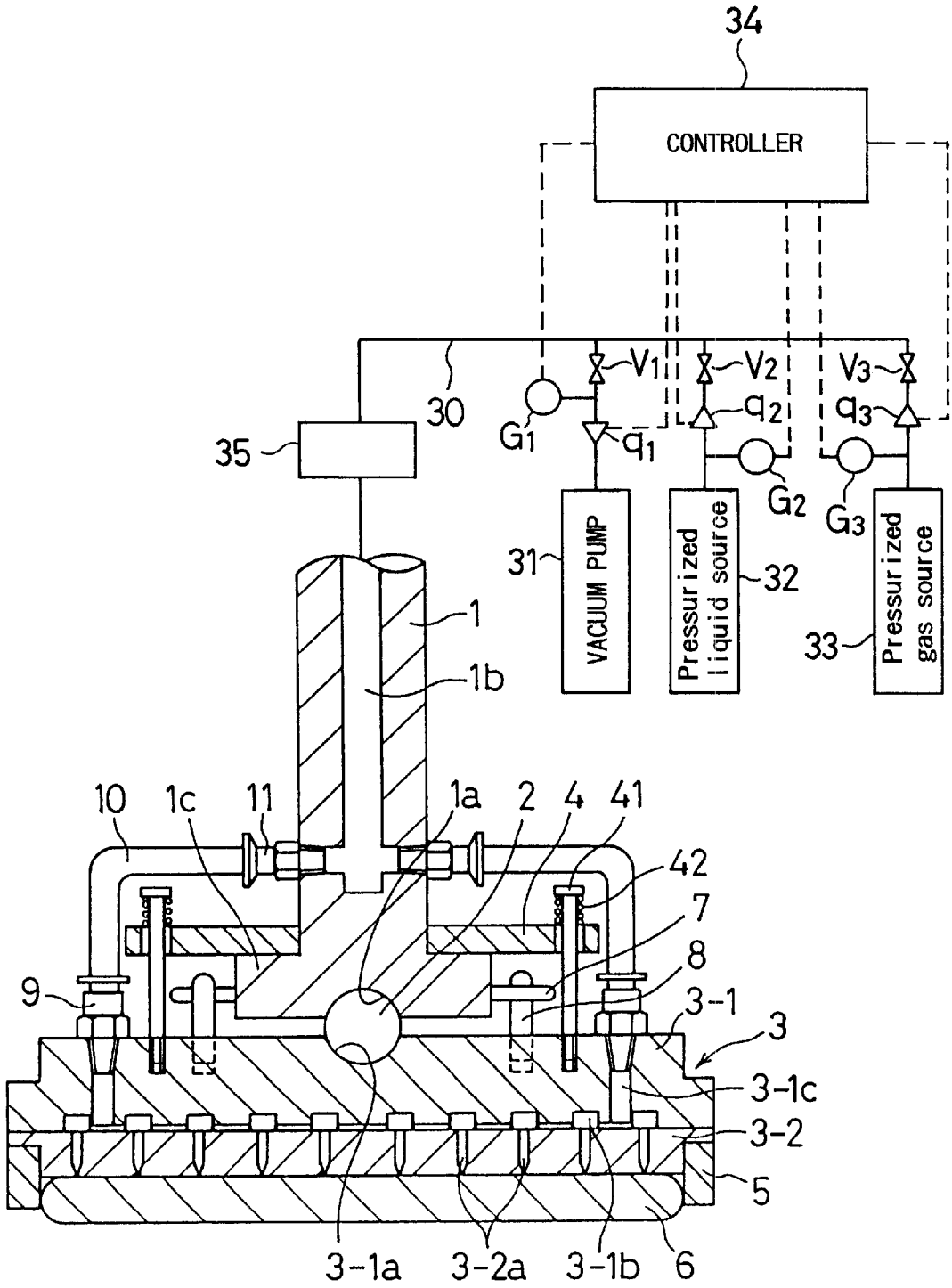
FIG. 1 is a vertical cross-sectional view of a polishing unit of a polishing apparatus according to the present invention.
Figure 2:
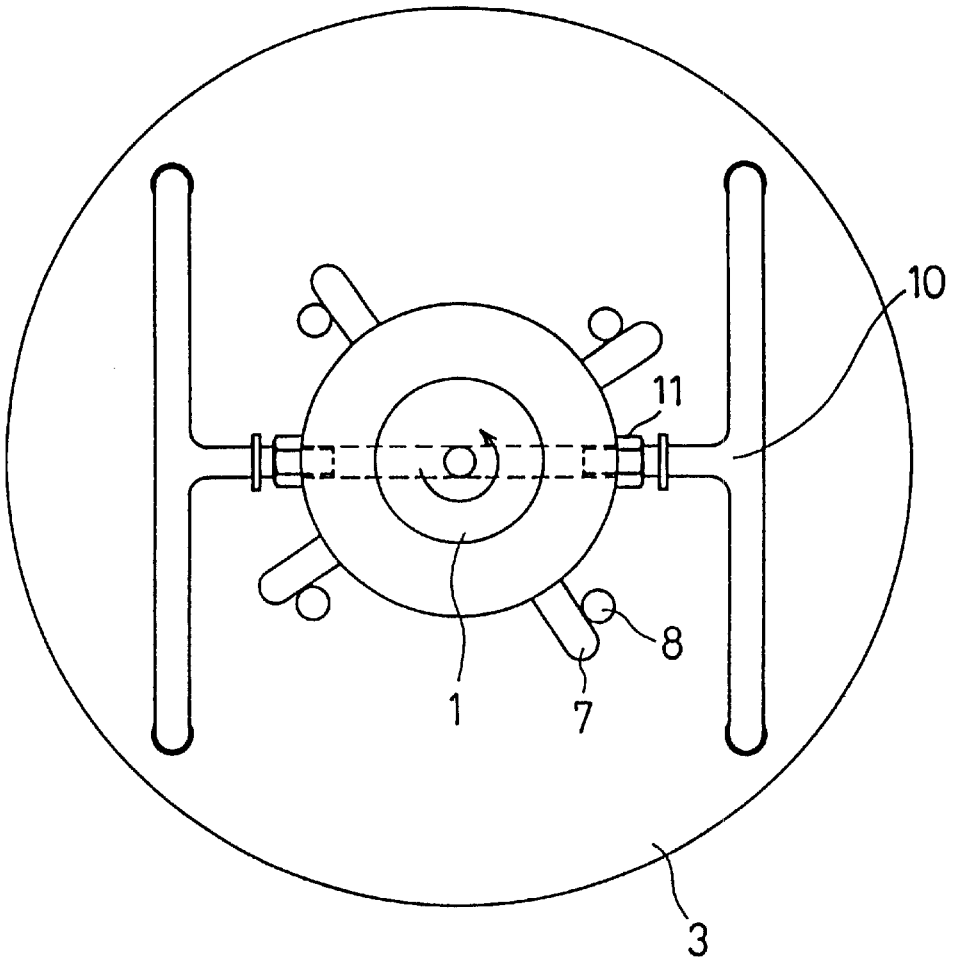
FIG. 2 is a plan view of the polishing unit shown in FIG. 1.

FIGS. 1 and 2 show a polishing unit of a polishing apparatus according to the present invention. As shown in FIGS. 1 and 2, the polishing unit comprises a vertical top ring drive shaft 1, a top ring 3, and a spherical bearing 2 interposed between the top ring drive shaft 1 and the top ring 3.

The top ring drive shaft 1 has a semi spherical recess 1*a* formed centrally in a lower end thereof and held in sliding contact with the spherical bearing 2. The top ring 3 comprises an upper top ring member 3-1 and a lower top ring member 3-2. The upper top ring member 3-1 has a semi spherical recess 3-1*a* formed centrally in an upper surface thereof and held in sliding contact with the spherical bearing 2. Therefore, the spherical bearing 2 is slideably received in the semi spherical recesses 1*a* and 3-1*a*. A retainer ring 5 is attached to an outer circumferential edge of the lower top ring member 3-2 for retaining a semiconductor wafer 6 on a lower surface of the lower top ring member 3-2.

The lower top ring member 3-2 has a plurality of openings 3-2*a* which are formed vertically therein and are open at the lower surface thereof. The upper top ring member 3-1 has a plurality of communication grooves 3-1*b* formed in a lower surface thereof and held in communication with the openings 3-2*a*. The communication grooves 3-1*b* communicate with four communication holes 3-1*c* formed vertically in the upper top ring member 3-1. The communication holes 3-1*c* are connected through tube couplings 9, tubes 10 and tube couplings 11 to a communication hole 1*b* formed centrally in the top ring drive shaft 1. The communication hole 1*b* is connected through a rotary joint 35 and a pipe 30 to a vacuum pump 31, a pressurized liquid source 32 and a pressurized gas source 33. The valves $V_1$, $V_2$ and $V_3$ are provided between the vacuum pump 31, the pressurized liquid source 32, the pressurized gas source 33 and the rotary joint 35, respectively.

The pressurized liquid source 32 contains a liquid such as pure water under pressure, and the pressurized gas source 33 contains a gas such as air or $N_2$ under pressure. To the pipe 30 between the valve $V_1$ and the vacuum pump 31, there are connected a pressure gauge $G_1$ for measuring the pressure upstream of the vacuum pump 31, and a flow meter $q_1$ for measuring the rate of discharge of a gas in a polishing environment such as air. To the pipe 30 between the valve $V_2$ and the pressurized liquid source 32, there are connected a pressure gauge $G_2$ for measuring the pressure downstream of the pressurized liquid source 32, and a flow meter $q_2$ for measuring the flow rate of the liquid. To the pipe 30 between the valve $V_3$ and the pressurized gas source 33, there are connected a pressure gauge $G_3$ for measuring the pressure downstream of the pressurized gas source 33, and a flow meter $q_3$ for measuring the flow rate of the gas. Pressure signals produced by the pressure gauge $G_1$, $G_2$ and $G_3$ and flow rate signals produced by the flowmeters $q_1$, $q_2$ and $q_3$ are sent to a controller 34 of the polishing apparatus. Each of the pressurized liquid source 32 and the pressurized gas source 33 has a mechanism (not shown) for establishing a pressure setting, and a mechanism (not shown) for maintaining a pressure in accordance with the pressure setting.

The top ring drive shaft 1 has a radially outwardly extending flange 1*c* on the lower end thereof. A plurality of torque transmitting pins 7 (four in the illustrated embodiment) are provided on the outer periphery of the flange 1*c*. The upper top ring member 3-1 has a plurality of vertical torque transmitting pins 8 (four in the illustrated embodiment) engage able with the respective torque transmitting pins 7.

Figure 3:
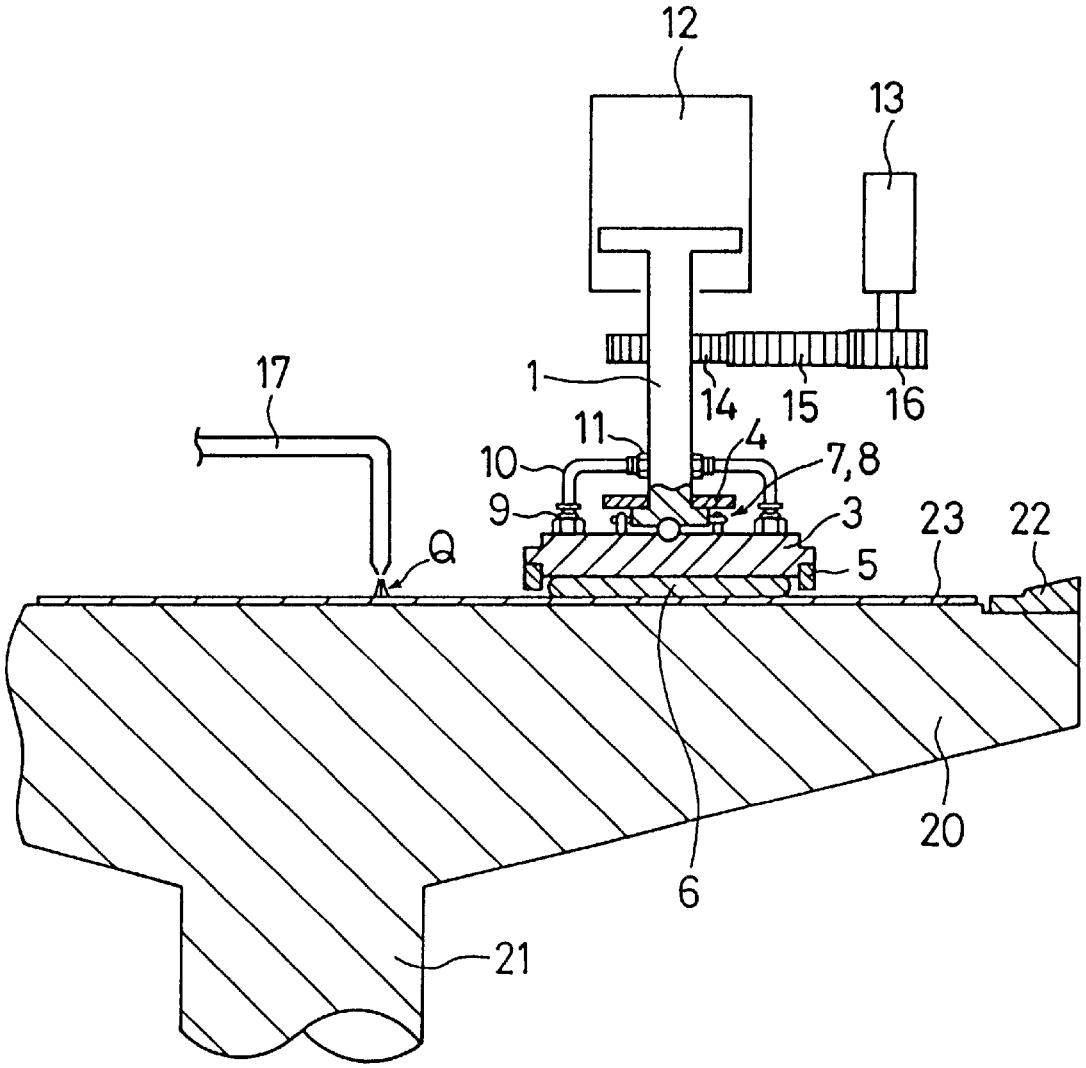
FIG. 3 is a vertical cross-sectional view of the polishing apparatus according to the present invention.

The semiconductor wafer 6 is accommodated in a space defined between the lower surface of the lower top ring member 3-2, the inner circumferential surface of the retainer ring 5 and the upper surface of a turntable 20 (see FIG. 3). When the turntable 20 and the top ring drive shaft 1 are rotated independently of each other, the torque from the top ring drive shaft 1 is transmitted through the torque transmitting pins 7, 8 which are held in engagement with each other to the top ring 3. While the top ring 3 is rotated, the semiconductor wafer 6 is slidingly moved on a polishing surface of the turntable 20 to thus polish the lower surface of the semiconductor wafer 6 to a flat mirror finish.

Bolts 41 are vertically fixed to the upper surface of the top ring 3. A top ring holder 4 is mounted on an upper surface of the flange 1*c* of the top ring drive shaft 1. Compression coil springs 42 are interposed between the heads of the bolts 41 and the top ring holder 4 for normally urging the top ring holder 4 downwardly to press the top ring holder 4 against the flange 1*c*.

FIG. 3 shows the polishing apparatus which incorporates the polishing unit shown in FIGS. 1 and 2. As shown in FIG. 3, the turntable 20 is rotatable by a shaft 21 about its own axis. A turntable ring 22 is mounted on the upper outer circumferential surface of the turntable 20 for preventing an abrasive liquid Q from being scattered off the turntable 20. A polishing cloth 23 is attached to the upper surface of the turntable 20. A top ring cylinder 12 is connected to the upper end of the top ring drive shaft 1 for pressing the top ring 3 downwardly against the turntable 20. The top ring drive shaft 1 is operatively coupled to a top ring drive motor 13 by a train of inter meshing gears 14, 15 and 16, so that the top ring 3 can be rotated about its own axis by the top ring drive motor 13.

The polishing apparatus operates as follows: The semiconductor wafer 6 is held on the lower surface of the lower top ring member 3-2 under vacuum. The top ring 3 and the turntable 20 are rotated independently of each other to produce relative rotary motion therebetween, and the top ring cylinder 12 is actuated to press the semiconductor wafer 6 held by the top ring 3 downwardly against the polishing cloth 23. At this time, the abrasive liquid Q is being supplied from an abrasive liquid nozzle 17 onto the polishing cloth 23. The supplied abrasive liquid Q is retained on the polishing cloth 23, and the lower surface of the semiconductor wafer 6 is polished by the polishing cloth 23 retaining the abrasive liquid Q.

Prior to the process of polishing the semiconductor wafer 6, the semiconductor wafer 6 is attached to the lower surface of the top ring 3 under vacuum in a wafer transfer position. Specifically, the valve $V_1$ is opened, and the vacuum pump 31 is operated to apply suction to the openings 3-2*a* through the pipe 30, the communication hole 1*b*, the tubes 10, the communication holes 3-1*c* and the communication grooves 3-1*b*, thereby attracting the semiconductor wafer 6 to the lower surface of the top ring 3. The attraction of the semiconductor wafer 6 to the top ring 3 can be confirmed as it is completed when either the pressure reading on the pressure gauge $G_1$ or the flow rate reading on the flow meter $q_1$ becomes lower than a predetermined level within a predetermined period of time. If the completion of the attraction of the semiconductor wafer 6 to the top ring 3 is confirmed, then the polishing apparatus can carry out a next process such as the polishing process. If the completion of the attraction of the semiconductor wafer 6 to the top ring 3 is not confirmed within the predetermined period of time, then the semiconductor wafer 6 may possibly be attracted to the top ring 3 in a deviated position. If the polishing process is carried out in this state, the semiconductor wafer 6 may possibly be damaged in the polishing process. In such a case, therefore, the controller 34 regards the polishing unit as a malfunction, and automatically shuts down the polishing apparatus and sounds the alarm for the malfunction. After the completion of the attraction of the semiconductor wafer 6 to the top ring 3 is confirmed, the semiconductor wafer 6 held by the top ring 3 under vacuum is transferred from the wafer transfer position to a polishing position over the turntable 20. During this time, the holding of the semiconductor wafer 6 by the top ring 3 is continuously confirmed on the basis of the pressure reading on the pressure gauge $G_1$ or the flow rate reading on the flow meter $q_1$.

In the polishing process, the top ring 3 is lowered to press the semiconductor wafer 6 against the polishing cloth 23, and the top ring 3 and the turntable 20 are rotated to polish the semiconductor wafer 6 in the manner described above. During the polishing process, the valve $V_1$ is closed to stop applying suction to the openings 3-2*a*, and the valve $V_3$ is opened to supply the gas under a predetermined pressure from the pressurized gas source 33 to the openings 3-2*a* through the pipe 30, the communication hole 1*b*, the tubes 10, the communication holes 3-1*c* and the communication grooves 3-1*b*, and hence to the upper surface of the semiconductor wafer 6. At this time, the controller 34 monitors the pressure reading on the pressure gauge $G_3$ and the flow rate reading on the flow meter $q_3$. If the polishing process suffers a malfunction, then the controller 34 detects a change in the pressure reading on the pressure gauge $G_3$ and/or a change in the flow rate reading on the flow meter $q_3$. For example, when the semiconductor wafer 6 is broken while it is being polished, some of the openings 3-2*a* may be clogged with wafer fragments, thereby imposing increased resistance to the flow of the supplied gas. As a result, the flow rate of the gas is reduced and/or the pressure of the supplied gas is increased. When wafer fragments are held between the polishing cloth 23 and the retainer ring 5, or wafer fragments are superimposed between the polishing cloth 23 and the lower top ring member 3-2, a space between the polishing cloth 23 and the lower top ring member 3-2 is increased, thus reducing resistance to the flow of the supplied gas. As a result, the flow rate of the gas is increased and/or the pressure of the supplied gas is lowered temporarily. Furthermore, the pressure of the gas supplied from the pressurized gas source 33 may increase beyond the predetermined level due to a malfunction of the pressurized gas source 33. In this case, the pressure buildup of the supplied gas creates a gap between the semiconductor wafer 6 and the lower top ring member 3-2, thus tending to expel the semiconductor wafer 6 from the top ring 3 beyond the retainer ring 5.

When the controller 34 detects a change in either the pressure reading on the pressure gauge $G_3$ or the flow rate reading on the flowmeter $q_3$, the controller 34 immediately sends commands to stop rotations of the turntable 20 and the top ring 3, to lift the top ring 3 from the turntable 20 and to sound the alarm for the malfunction. The polishing process is now interrupted to release the load applied to the semiconductor wafer 6 during the polishing process. Consequently, it is possible to prevent the semiconductor wafer 6 from being broken and scattered around. Furthermore, when the polishing process is interrupted, the semiconductor wafer 6 which is not broken but is expelled from the top ring 3 may be checked for chipping or damage, and any semiconductor wafer 6 which is found to be easily breakable may be put aside as being not suitable for polishing. In this manner, the danger of breakage of the semiconductor wafers 6 is reduced while it is being polished. Instead of monitoring the semiconductor wafer 6 for damage with the pressure or the flow rate of the gas, the semiconductor wafer 6 may be monitored for damage with the pressure or the flow rate of a liquid.

After the polishing process, the valve $V_3$ is closed, and the valve $V_1$ is opened again to attract the semiconductor wafer 3 to the top ring 3 under vacuum. Thereafter, the top ring 3 is lifted and moved to the transfer position where the semiconductor wafer 3 can be detached or removed from the top ring 3. During this time, the semiconductor wafer 3 is continuously held by the top ring 3 under vacuum, and the attraction of the semiconductor wafer 6 to the top ring 3 is continuously monitored and confirmed. This is because the semiconductor wafer 3 tends to stick to the polishing cloth 23 due to the surface tension of the abrasive liquid Q, or any dislocation of the semiconductor wafer 6 with respect to the top ring 3 occurs while the top ring 3 is being moved.

A process of removing the semiconductor wafer 6 from the top ring 3 will be described below. The valve $V_1$ is closed, and the valve $V_2$ or $V_3$ is opened for a certain period of time to supply the liquid from the pressurized liquid source 32 or the gas from the pressurized gas source 33 through the pipe 30, the communication hole 1*b*, the tubes 10, the communication holes 3-1*c*, the communication grooves 3-1*b* and the openings 3-2*a* to the region between the lower surface of the top ring 3 and the upper surface of the semiconductor wafer 6 for thereby removing the semiconductor wafer 6 from the top ring 3.

After the semiconductor wafer 6 is removed from the top ring 3, the valve $V_2$ or $V_3$ is closed to stop supplying the liquid from the pressurized liquid source 32 or the gas from the pressurized gas source 33. Further, the valve $V_1$ is opened, and the vacuum pump 31 is operated to apply suction to the openings 3-2*a* through the pipe 30, the communication hole 1*b*, the tubes 10, the communication holes 3-1*c* and the communication grooves 3-1*b*. If the controller 34 detects when the pressure reading on the pressure gauge $G_1$ is lower than the pressure in the polishing environment and higher than a certain reference level or when the flow rate reading on the flow meter $q_1$ is higher than a certain reference level, whichever condition comes first within a predetermined period of time, then the controller 34 can confirm that the semiconductor wafer 6 is completely removed from the top ring 3. The polishing apparatus can now carry out a next process.

If the complete removal of the semiconductor wafer 6 from the top ring 3 is not confirmed, then the semiconductor wafer 6 may possibly remain attracted to the top ring 3. In such a state that the polished semiconductor wafer 6 remains on the top ring 3, a next semiconductor wafer 6 to be polished cannot be attracted to the top ring 3, or may stick to the polished semiconductor wafer 6. However, as no vacuum acts thereon, the next semiconductor wafer will drop and possibly be damaged. To avoid such trouble, when the polished semiconductor wafer 6 is not completely removed from the top ring 3, the controller 34 regards the polishing unit as a malfunction, and automatically shuts down the polishing apparatus.

The semiconductor wafer has been described as the planar workpiece to be polished by the polishing apparatus according to the present invention. However, the planar workpiece to be polished by the polishing apparatus may be a wafer having a metal circuit on a surface thereof, a wafer having an insulating film such as silicon oxide on such a metal circuit, a having no circuit pattern wafer, and a wafer having an insulating film such as silicon oxide thereon.

Although a certain preferred embodiment of the present invention has been shown and described in detail, it should be understood that various changes and modifications may be made therein without departing from the scope of the appended claims.

What is claimed is:

1. A method for polishing a lower surface of a workpiece, said method comprising:

holding a workpiece by a top ring;

polishing the lower surface of the workpiece by pressing the workpiece against a polishing surface;

detecting a positive pressure of a fluid which is supplied to an upper surface of the workpiece while the workpiece is being polished; and stopping polishing of the workpiece when the detected pressure changes.

2. A method according to claim 1, further comprising:

attracting the workpiece to said top ring under vacuum from a vacuum source; and detecting at least one of a pressure and a flow rate of a gas in a vacuum line interconnecting said top ring and said vacuum source to judge whether the workpiece is properly attracted to said top ring.

3. A method according to claim 2, further comprising:

supplying a fluid under pressure between the workpiece and said top ring to detach the workpiece from said top ring ;

operating said vacuum source; and detecting at least one of a pressure and a flow rate of a gas in said vacuum line interconnecting said top ring and said vacuum source to judge whether the workpiece is detached from said top ring.

4. A method according to claim 1, wherein said workpiece is a semiconductor wafer.

5. A method for polishing a lower surface of a workpiece, said method comprising:

attracting a workpiece to a top ring under vacuum from a vacuum source;

detecting at least one of a pressure and a flow rate of a gas in a vacuum line interconnecting said top ring and said vacuum source to judge whether the workpiece is properly attracted to said top ring;

polishing the lower surface of the workpiece by pressing the workpiece against a polishing surface; and detecting a positive pressure of a fluid which is supplied to an upper surface of the workpiece while the workpiece is being polished to judge whether the workpiece is damaged.

6. A method according to claim 5, further comprising:

attracting the workpiece to said top ring under vacuum from said vacuum source after polishing of the workpiece is completed; and detecting at least one of a pressure and a flow rate of a gas in said vacuum line interconnecting said top ring and said vacuum source to judge whether the workpiece is properly attracted to said top ring.

7. A method according to claim 6, further comprising:

supplying a fluid under pressure between the workpiece and said top ring to detach the workpiece from said top ring;

operating said vacuum source; and detecting at least one of a pressure and a flow rate of a gas in said vacuum line interconnecting said top ring and said vacuum source to judge whether the workpiece is detached from said top ring.

8. A method according to claim 5, wherein said workpiece is a semiconductor wafer.

9. An apparatus for polishing a lower surface of a workpiece, said apparatus comprising:

a polishing surface;

a top ring disposed above said polishing surface and holding a workpiece to be polished and pressing the workpiece against said polishing surface, said top ring having a plurality of openings;

a pressurized fluid source for supplying a fluid under pressure through said openings to an upper surface of the workpiece;

a detector disposed between said openings and said pressurized fluid source for detecting a positive pressure of the fluid supplied from said pressurized fluid source; and a controller for stopping polishing of the workpiece when the detected pressure changes.

10. An apparatus according to claim 9, further comprising:

a vacuum source for attracting the workpiece to said top ring under vacuum; and a detector for detecting at least one of a pressure and a flow rate of a gas in a vacuum line interconnecting said top ring and said vacuum source.

11. An apparatus according to claim 10, wherein said controller judges whether the workpiece is properly attracted to said top ring, on the basis of at least one of the detected pressure and the detected flow rate of the gas.

12. An apparatus according to claim 10, wherein said controller judges whether the workpiece is detached from said top ring, on the basis of at least one of the detected pressure and the detected flow rate of the gas.

13. A method for polishing a surface of a workpiece, said method comprising;

holding a workpiece by a top ring;

polishing the surface of the workpiece by pressing the workpiece against a polishing surface while rotating said top ring and workpiece;

detecting a malfunction of said polishing; and stopping rotation of said top ring and lifting said top ring from said polishing surface;

wherein said detecting is conducted by detecting a positive pressure of a fluid which is supplied to said top ring.

14. A method according to claim 13, wherein said malfunction includes the situation when said workpiece is broken, damaged, or disengaged from the top ring.

15. A method according to claim 13, wherein said stopping rotation of said top ring or lifting said top ring is automatically conducted by a controller.

16. A method for polishing a surface of a workpiece, said method comprising:

holding a workpiece by a top ring;

polishing the surface of the workpiece by pressing the workpiece against a polishing surface while rotating said top ring and workpiece;

detecting a malfunction of said polishing; and lifting said top ring from said polishing surface;

wherein said detecting is conducted by detecting a positive pressure of a fluid which is supplied to said top ring.

* * * * *